US012631372B2

(12) United States Patent
Baik et al.

(10) Patent No.: US 12,631,372 B2
(45) Date of Patent: May 19, 2026

(54) LIQUID HYDROGEN VAPORIZATION SYSTEM AND LIQUID HYDROGEN VAPORIZATION METHOD

(71) Applicant: H2CREO Corp., Dover, DE (US)

(72) Inventors: Jong H Baik, Titusville, FL (US); Hyung Jin Kim, Gyeonggi-do (KR); Sung Yong Kim, Gyeonggi-do (KR)

(73) Assignee: H2CREO Corp., Dover, DE (US)

( * ) Notice: Subject to any disclaimer, the term of this patent is extended or adjusted under 35 U.S.C. 154(b) by 155 days.

(21) Appl. No.: 18/436,664

(22) Filed: Feb. 8, 2024

(65) Prior Publication Data

US 2024/0310083 A1 Sep. 19, 2024

Related U.S. Application Data

(60) Provisional application No. 63/452,776, filed on Mar. 17, 2023.

(51) Int. Cl.
*F25B 43/00* (2006.01)
*F25B 1/10* (2006.01)

(52) U.S. Cl.
CPC ..... *F25B 1/10* (2013.01); *F25B 43/00* (2013.01)

(58) Field of Classification Search
CPC . F25B 1/10; F25B 43/00; F25B 43/003; F25J 1/0012; F25J 1/0015; F25J 1/0017; F25J 1/0067; F25J 1/02; F25J 1/0201; F25J 1/0202; F25J 2215/10
See application file for complete search history.

(56) References Cited

FOREIGN PATENT DOCUMENTS

| | | | | |
|---|---|---|---|---|
| CN | 111664516 A | * | 9/2020 | ..... F24F 11/89 |
| EP | 4342784 A1 | * | 3/2024 | ..... F02M 21/0227 |
| JP | 2019-516054 A | | 6/2019 | |
| JP | 2003-056800 A | | 2/2023 | |
| KR | 10-0310819 | | 2/2001 | |
| KR | 20170027101 A | * | 3/2017 | ..... F17C 9/02 |
| KR | 10-2022-0021954 A | | 2/2022 | |
| KR | 10-2022-0143214 A | | 10/2022 | |

* cited by examiner

*Primary Examiner* — Miguel A Diaz
(74) *Attorney, Agent, or Firm* — Moser Taboada

(57) ABSTRACT

The present disclosure relates to a liquid hydrogen vaporization system and a liquid hydrogen vaporization method for vaporizing hydrogen in a liquid state into a gaseous state so as to supply hydrogen to a fuel cell, comprising a blower for supercharging wet air in atmosphere, a moisture eliminator for removing moisture contained in wet air supercharged through the blower and converting wet air into dry air, and a heat exchange unit for heating hydrogen through heat exchange between dry air and hydrogen so that hydrogen in a liquid state supplied from a hydrogen tank can be vaporized into a gaseous state and be supplied to a fuel cell, wherein the moisture eliminator condenses moisture contained in wet air by using cooling energy released when hydrogen supplied from the hydrogen tank vaporizes, thereby removing moisture contained in wet air.

20 Claims, 5 Drawing Sheets

LIQUID HYDROGEN VAPORIZATION SYSTEM AND LIQUID HYDROGEN VAPORIZATION METHOD

CROSS-REFERENCE TO RELATED APPLICATIONS

The present application claims the benefit of and priority to U.S. Provisional Application Ser. No. 63/452,776, filed on Mar. 17, 2023, the entire contents of which is incorporated herein by reference.

BACKGROUND

1. Field of the Invention

The present disclosure relates to a liquid hydrogen vaporization system and a liquid hydrogen vaporization method, and more specifically, to a liquid hydrogen vaporization system and a liquid hydrogen vaporization method for vaporizing hydrogen in a liquid state into a gaseous state so as to supply hydrogen to a fuel cell.

2. Description of the Related Art

Demand for replacing gaseous hydrogen with liquid hydrogen as a fuel in conventional hydrogen transportation vehicles is increasing due to its higher storage density compared to high-pressure hydrogen. In particular, liquid hydrogen is very suitable as a fuel for aircraft or trucks (i.e., heavy duty vehicles) for long-distance transportation. In order to use such liquid hydrogen as a fuel in a fuel cell, it must be supplied as gaseous hydrogen suitable for pressure conditions of a fuel cell. For this purpose, it is necessary to convert liquid hydrogen into gaseous hydrogen using an evaporator.

In general, liquefied gas (e.g., LNG, liquid nitrogen, liquid hydrogen or the like) evaporators vaporize liquefied gas by directly burning fuels or obtaining evaporation heat by heating liquefied gas with seawater, atmosphere or the like. In case of liquid hydrogen, it is vaporized by using a pipe-type stationary heat exchanger that exchanges heat with atmosphere through natural convection.

However, the conventional liquid hydrogen vaporization system and the liquid hydrogen vaporization method which exchange heat with atmosphere has had a problem in that such system and method vaporize hydrogen with heat in atmosphere while liquid hydrogen flows through a pipe with an expanded heat transfer surface, since its heat exchange efficiency is low, and thus a volume of a heat exchanger becomes large and moisture in atmosphere is condensed and coagulated on outside of the pipe during a process of heat exchange resulting in reduction of efficiency of the evaporator. Further, the evaporator had to be made larger due to ice frozen therein. Specifically, if the evaporator installed on a vehicle were to freeze, it could significantly disrupt vehicle operations and lead to accidents.

SUMMARY

The present disclosure is intended to solve various problems including the problems described above and has a purpose to provide a liquid hydrogen vaporization system and a liquid hydrogen vaporization method having an evaporator capable of effectively vaporizing liquid hydrogen and having a structure that prevents atmospheric moisture from freezing during a heat exchange process. However, these problems are exemplary, and a scope of the present disclosure is not limited thereto.

According to an aspect of the present disclosure, a liquid hydrogen vaporization system is provided. The liquid hydrogen vaporization system may comprise a blower for supercharging wet air in atmosphere, a moisture eliminator for removing moisture contained in wet air supercharged through the blower and converting wet air into dry air, and a heat exchange unit for heating hydrogen through heat exchange between dry air and hydrogen so that hydrogen in a liquid state supplied from a hydrogen tank can be vaporized into a gaseous state and supplied to a fuel cell, wherein the moisture eliminator may condense moisture contained in wet air by using cooling energy released when hydrogen supplied from the hydrogen tank vaporizes, thereby removing moisture contained in wet air.

According to an embodiment of the present disclosure, the moisture eliminator may include a cooling module for forming a cooling space in which wet air can be cooled and converted into dry air; a cooling line formed in a spiral shape along an inner circumferential surface of the cooling module and flowing hydrogen supplied from the hydrogen tank toward the heat exchange unit so as to form cooling atmosphere in the cooling space; an air inlet formed to penetrate a side portion of the cooling module so as to introduce wet air supercharged through the blower into the cooling space of the cooling module; and an air outlet formed to penetrate an upper portion of the cooling module so as to discharge dry air, which had been converted in the cooling space, toward the heat exchange unit.

According to an embodiment of the present disclosure, the cooling line may be formed in a downward spiral shape spirally extending from an upper side to a lower side along an inner circumferential surface of the cooling module.

According to an embodiment of the present disclosure, the cooling line may release cooling energy, which had been generated in a process that at least a portion of hydrogen is vaporized, to the cooling space, and may discharge hydrogen mixed in a liquid state and a gaseous state toward the heat exchange unit.

According to an embodiment of the present disclosure, the air inlet may be formed on an upper side of the cooling module to be in contact with an outer circumferential surface of the cooling module so that wet air flowing into the cooling space has a swirling flow from an upper side to a lower side along the cooling line that is spirally formed in the cooling space.

According to an embodiment of the present disclosure, the air outlet may be formed in a cylindrical shape having an axis coaxial with a central axis of the cooling module, and may penetrate the upper portion of the cooling module and extend in a direction toward a lower side of the cooling space.

According to an embodiment of the present disclosure, the air outlet may be installed with a filter in at least a partial section thereof so as to filter moisture remaining in dry air to be discharged to outside of the cooling module.

According to an embodiment of the present disclosure, the heat exchange unit may include a first heat exchanger installed on a hydrogen line connecting the moisture eliminator and the fuel cell, heating hydrogen to a first heating temperature through heat exchange between dry air and hydrogen.

According to an embodiment of the present disclosure, the first heat exchanger may cool dry air to a predetermined liquefaction temperature or lower through heat exchange between dry air and hydrogen, and may separate cooled dry air into liquefied air or liquid nitrogen and liquefied oxygen to discharge them separately.

According to an embodiment of the present disclosure, the heat exchange unit may include a second heat exchanger installed at a rear of the first heat exchanger on the hydrogen line based on a flow direction of hydrogen flowing through the hydrogen line toward the fuel cell, heating hydrogen to a second heating temperature higher than the first heating temperature through heat exchange between dry air and hydrogen.

According to an embodiment of the present disclosure, the heat exchange unit may further include a distributor for controlling and distributing an amount of dry air supplied to at least one of the first heat exchanger and the second heat exchanger.

According to an embodiment of the present disclosure, the distributor may be installed at a branch of an air line, which connects the moisture eliminator and the heat exchange unit and branches in a middle to connect the first heat exchanger and the second heat exchanger in parallel and flows dry air to the first heat exchanger and the second heat exchanger, respectively; and may distribute dry air discharged from the moisture eliminator at a predetermined distribution ratio and discharge the distributed dry air to the first heat exchanger and the second heat exchanger.

According to an embodiment of the present disclosure, the distributor may be installed between the second heat exchanger and the first heat exchanger on the air line, which connects the moisture eliminator and the heat exchange unit, connects the second heat exchanger and the first heat exchanger in series, and flows dry air in an order of the second heat exchanger and the first heat exchanger based on a flow direction of dry air, and may distribute dry air, which had been separated into oxygen gas and nitrogen gas in a process of passing through the second heat exchanger, at a predetermined distribution ratio, to be discharged to the first heat exchanger and atmosphere.

According to an embodiment of the present disclosure, the heat exchange unit may further include a heater installed, on an air line, in front of the second heat exchanger based on a flow direction of dry air, heating dry air flowing into the second heat exchanger to room temperature or higher.

According to an embodiment of the present disclosure, the first heat exchanger and the second heat exchanger may be plate-fin exchangers.

According to other aspect of the present disclosure, a liquid hydrogen vaporization system is provided. The liquid hydrogen vaporization system may comprise a blower for supercharging wet air in atmosphere; a moisture eliminator for removing moisture contained in wet air supercharged through the blower and converting wet air into dry air; and a heat exchange unit for heating hydrogen through heat exchange between dry air and hydrogen so that hydrogen in a liquid state supplied from a hydrogen tank can be vaporized into a gaseous state and supplied to a fuel cell, wherein the moisture eliminator may include a cooling module for forming a cooling space in which wet air can be cooled and converted into dry air by condensing moisture contained in wet air by using cooling energy released when hydrogen supplied from the hydrogen tank vaporizes so as to remove moisture contained in wet air; a cooling line formed in a downward spiral shape from an upper side to a lower side along an inner circumferential surface of the cooling module so as to form cooling atmosphere in the cooling space, releasing cooling energy, which had been generated in a process that at least a portion of hydrogen is vaporized, to the cooling space, and discharging hydrogen mixed in a liquid state and a gaseous state toward the heat exchange unit; an air inlet formed on an upper side of the cooling module to be in contact with an outer circumferential surface of the cooling module and penetrate a side portion of the cooling module so as to introduce wet air supercharged through the blower into the cooling space of the cooling module; and an air outlet formed in a cylindrical shape having an axis coaxial with a central axis of the cooling module so as to discharge dry air, which had been converted in the cooling space, toward the heat exchange unit, penetrating an upper portion of the cooling module and extending in a direction toward a lower side of the cooling space; wherein the heat exchange unit may include a first heat exchanger installed on a hydrogen line connecting the moisture eliminator and the fuel cell, heating hydrogen to a first heating temperature through heat exchange between dry air and hydrogen; a second heat exchanger installed at a rear of the first heat exchanger on the hydrogen line based on a flow direction of hydrogen flowing through the hydrogen line toward the fuel cell, heating hydrogen to a second heating temperature higher than the first heating temperature through heat exchange between dry air and hydrogen; a distributor for controlling and distributing an amount of dry air supplied to at least one of the first heat exchanger and the second heat exchanger; and a heater installed in front of the second heat exchanger based on a flow direction of dry air, heating dry air flowing into the second heat exchanger to room temperature or higher; and the first heat exchanger and the second heat exchanger may be plate-fin exchangers.

According to another aspect of the present disclosure, a liquid hydrogen vaporization method is provided. The liquid hydrogen vaporization method may comprise, (a) supercharging wet air in atmosphere; (b) removing moisture contained in supercharged wet air and converting wet air into dry air; (c) heat exchanging for heating hydrogen through heat exchange between dry air and hydrogen so that hydrogen in a liquid state supplied from a hydrogen tank can be vaporized into a gaseous state and supplied to a fuel cell; wherein, in (b), moisture contained in wet air can be removed by condensing moisture contained in wet air by using cooling energy released when hydrogen supplied from the hydrogen tank vaporizes.

According to another embodiment of the present disclosure, (c) may include (c-1) a first heat exchanging for heating hydrogen to a first heating temperature through heat exchange between dry air, which had been converted in (b), and hydrogen supplied from the hydrogen tank; and (c-2) a second heat exchanging for heating hydrogen to a second heating temperature higher than the first heating temperature through heat exchange between dry air, which had been converted in (b), and hydrogen heated to the first heating temperature; wherein (c-1) and (c-2) may be performed through plate-fin exchangers.

According to another embodiment, in (c-1), dry air may be cooled to a predetermined liquefaction temperature or lower through heat exchange between dry air and hydrogen, and may be separated into liquefied air or liquid nitrogen and liquefied oxygen to be discharged separately.

According to another embodiment, in (c-2), dry air may be heated to room temperature or higher by passing dry air through the heater before heat exchange with hydrogen.

According to an embodiment of the present disclosure configured as described above, for heat exchange with hydrogen, moisture contained in wet air in atmosphere flowing into a heat exchange unit can be removed through condensation preprocessing by using cooling energy released when hydrogen vaporizes, and wet air flowing into the heat exchange unit can be converted to dry air, thereby preventing freezing of the heat exchanger due to moisture contained in air in a process of heat exchange.

In this way, freezing can be prevented during a heat exchange process in a heat exchange unit such that a hydrogen supply system of a fuel cell can be configured in which plate-fin heat exchangers that can effectively vaporize liquid hydrogen are applied to a heat exchange unit as a heat exchanger. In addition, a liquid hydrogen vaporization system and a liquid hydrogen vaporization method can be implemented which liquefy dry air by using cooling energy generated when liquid hydrogen vaporizes, in a process of heat exchange between hydrogen and dry air in a heat exchanger, thereby producing liquid nitrogen and liquid oxygen together. However, a scope of the present disclosure is not limited by these effects.

DETAILED DESCRIPTION

Figure 1:
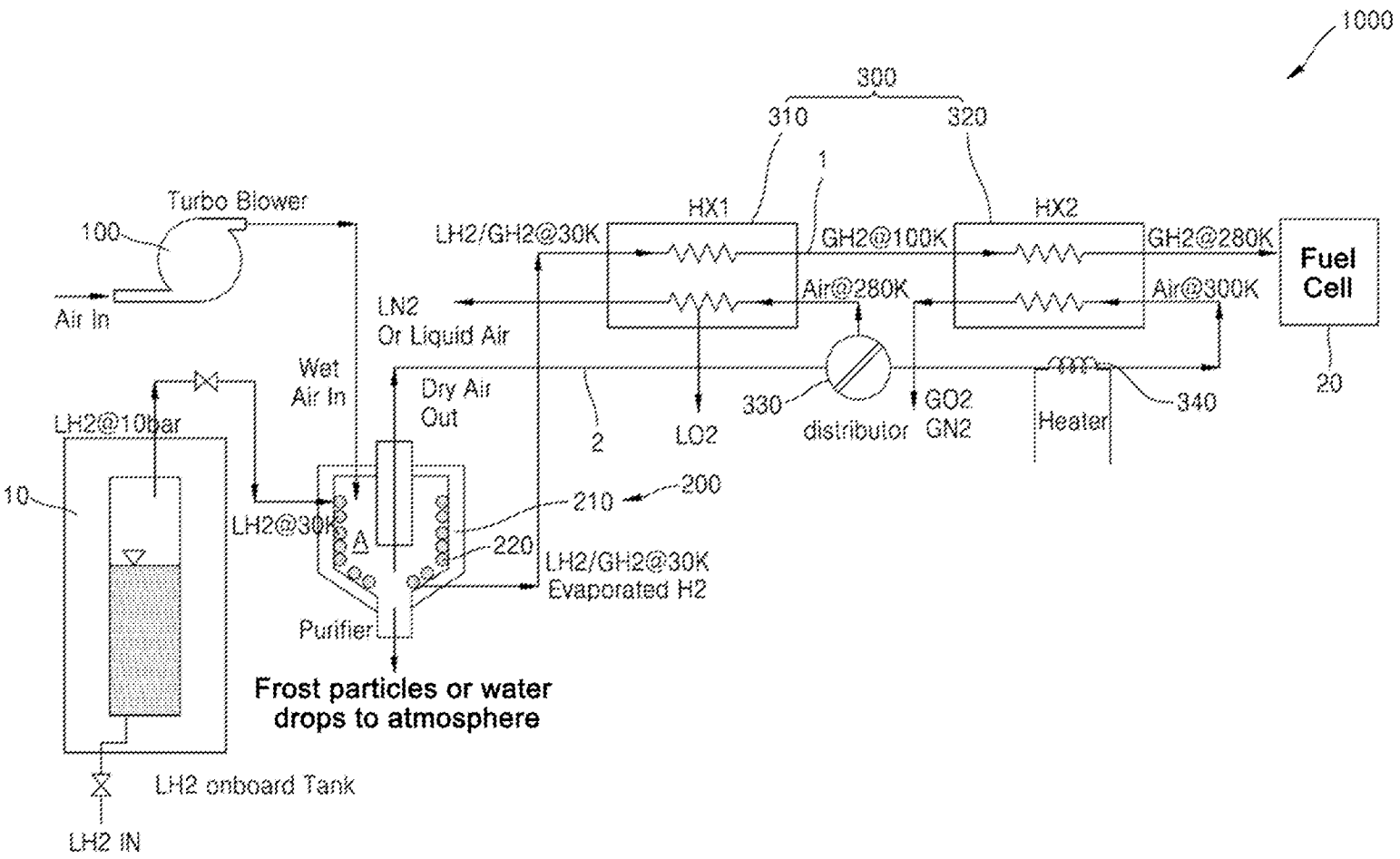
FIG. 1 is a conceptual view schematically showing a liquid hydrogen vaporization system according to an embodiment of the present disclosure.

Hereinafter, various preferred embodiments of the present disclosure will be described in detail with reference to the appended drawings.

The embodiments of the present disclosure are provided to more completely explain the present disclosure to those skilled in the art, and the following embodiments can be modified into various other forms, and the scope of the present disclosure is not limited to the following embodiments. Rather, these embodiments are provided to make the present disclosure more faithful and complete and to fully convey the spirit of the present disclosure to those skilled in the art. Additionally, the thickness and size of each layer in the drawings are exaggerated for convenience and clarity of explanation.

Hereinafter, embodiments of the present disclosure will now be described with reference to drawings that schematically show ideal embodiments of the present disclosure. In the drawings, variations of a depicted shape may be expected, for example, depending on manufacturing technology and/or tolerances. Accordingly, embodiments of the present disclosure should not be construed as being limited to the specific shape of the area shown in this specification, but should include, for example, changes in shape resulting from manufacturing.

Figure 2:
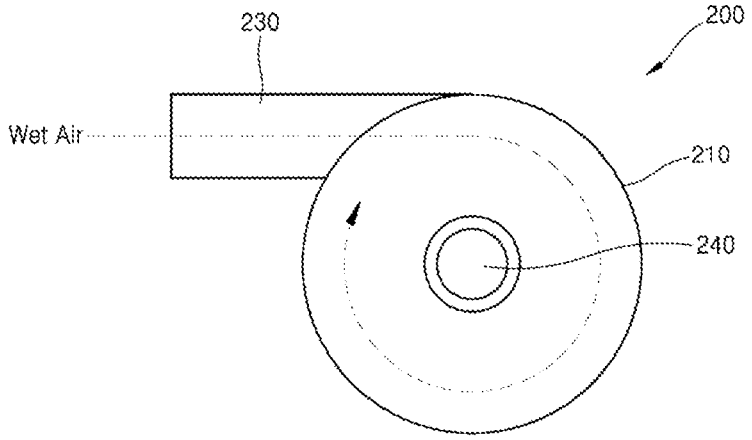
FIG. 2 is a cross-sectional view schematically showing a moisture eliminator included in the liquid hydrogen vaporization system of FIG. 1.
Figure 3:
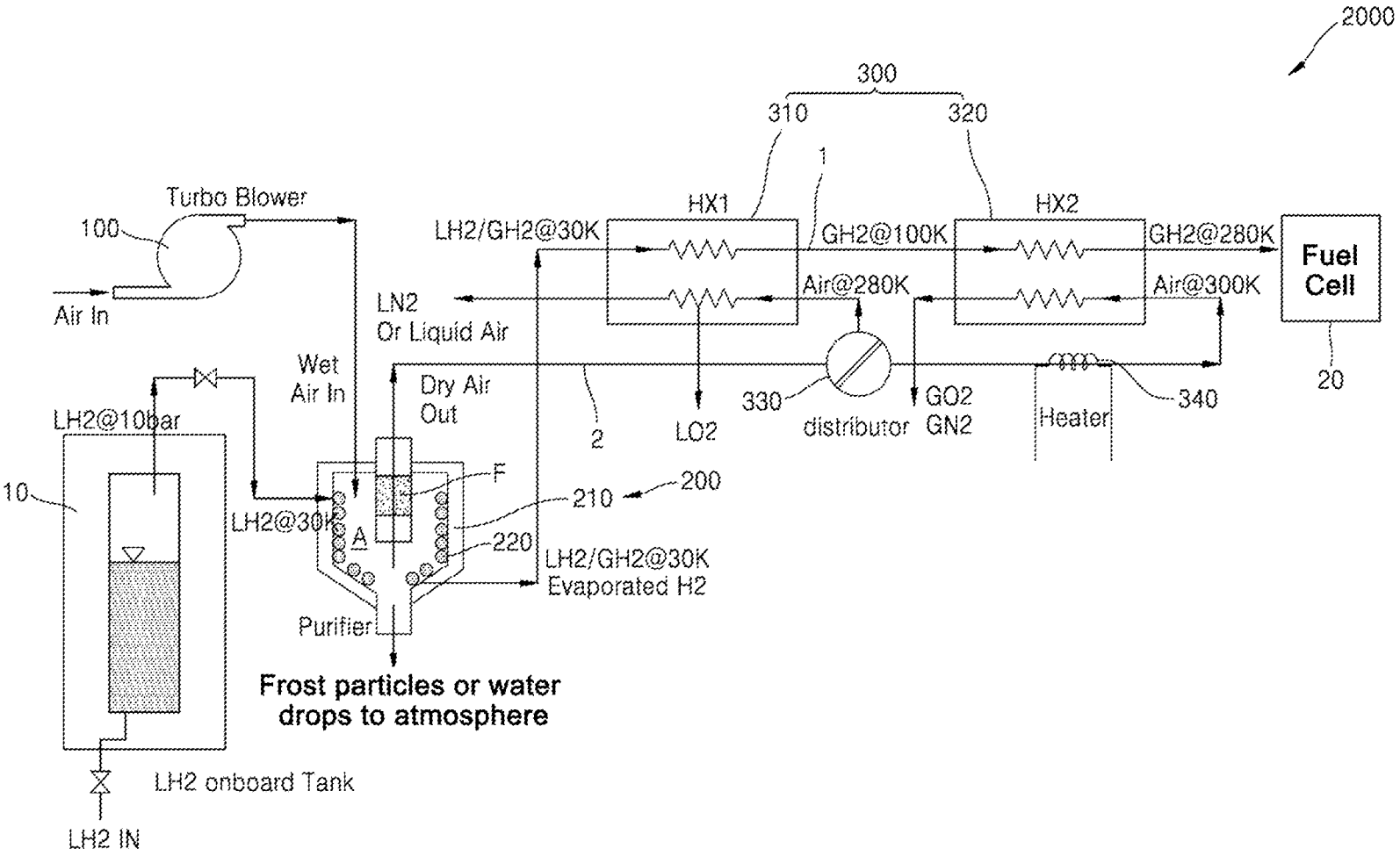
FIG. 3 is a conceptual view schematically showing a liquid hydrogen vaporization system according to the other embodiment of the present disclosure.
Figure 4:
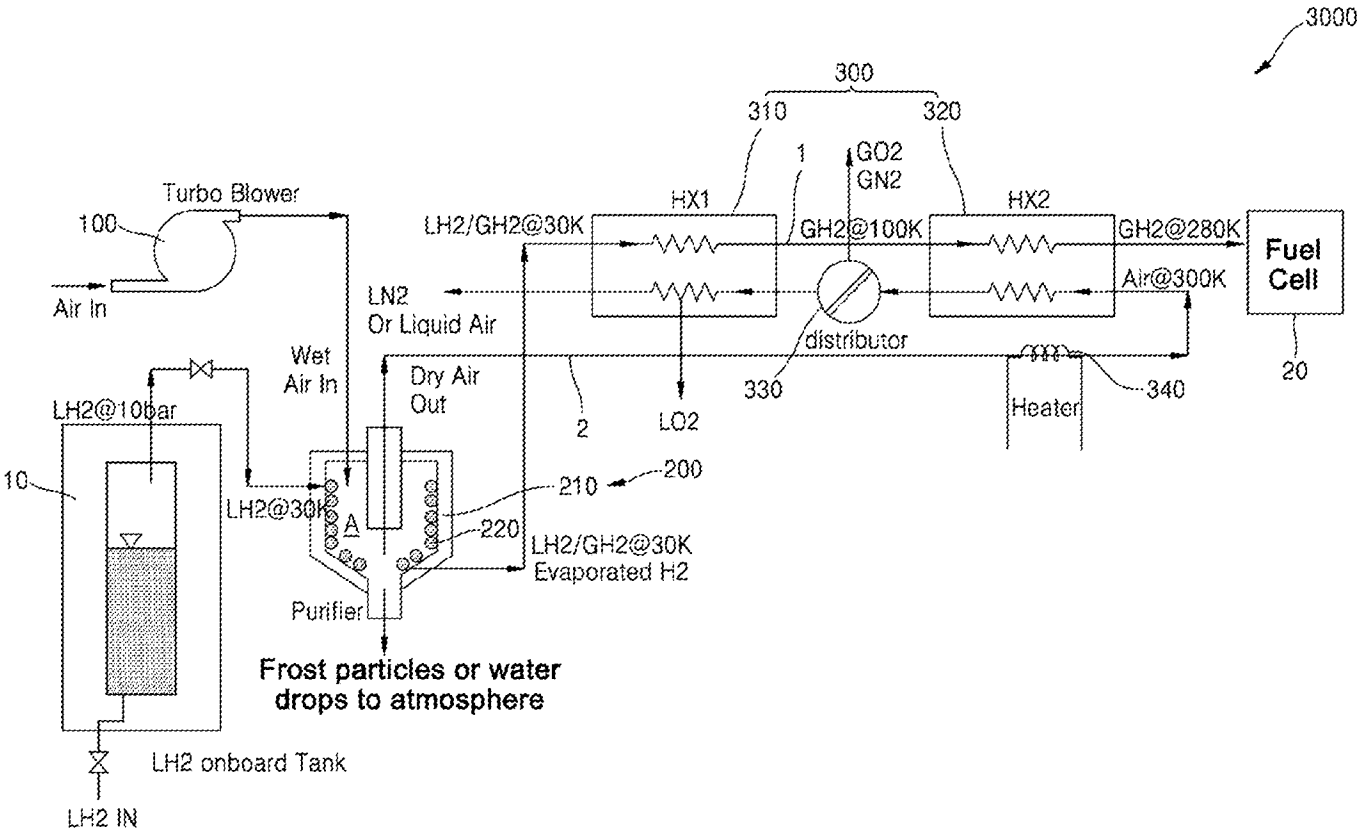
FIG. 4 is a conceptual view schematically showing a liquid hydrogen vaporization system according to another embodiment of the present disclosure.

FIG. 1 is a conceptual view schematically showing a liquid hydrogen vaporization system 1000 according to an embodiment of the present disclosure; FIG. 2 is a cross-sectional view schematically showing a moisture eliminator 200 included in the liquid hydrogen vaporization system 1000 of FIG. 1; FIG. 3 is a conceptual view schematically showing a liquid hydrogen vaporization system 2000 according to the other embodiment of the present disclosure; and FIG. 4 is a conceptual view schematically showing a liquid hydrogen vaporization system 3000 according to another embodiment of the present disclosure.

As shown in FIG. 1, the liquid hydrogen vaporization system 1000 according to an embodiment of the present disclosure may primarily include a blower 100, a moisture eliminator 200, and a heat exchange unit 300.

As shown in FIG. 1, the blower 100 may supercharge wet air in atmosphere toward the moisture eliminator 200 so that air for heat exchange with hydrogen can be supplied to the heat exchange unit 300, which will be described later.

For example, the blower 100 is a type of a turbo blower, and may compress wet air in atmosphere into compressed air so that a sufficient amount of air to vaporize liquid hydrogen can be supplied to the heat exchange unit 300.

In this way, the liquid hydrogen vaporization system 1000 according to an embodiment of the present disclosure may supercharge compressed air to the heat exchange unit 300 using the blower 100, and may provide a sufficient amount of air for liquid hydrogen to be vaporized, thereby implementing a heat exchanger that is more compact than a conventional heat exchanger using a natural convection method.

As shown in FIG. 1, the moisture eliminator 200 may remove moisture contained in wet air supercharged through the blower 100 and convert wet air into dry air.

The moisture eliminator 200 may remove moisture contained in wet air by condensing moisture contained in wet air by using cooling energy released when hydrogen supplied from a hydrogen tank 10 vaporizes.

For example, the moisture eliminator 200 may include a cooling module 210 generally formed in a hopper-shaped cylindrical shape so as to form a cooling space A where wet air can be cooled and converted into dry air; a cooling line 220 formed in a spiral shape along an inner circumferential surface of the cooling module 210 and flowing hydrogen supplied from the hydrogen tank 10 toward the heat exchange unit 300 so as to form cooling atmosphere in the cooling space A; an air inlet 230 formed to penetrate a side portion of the cooling module 210 so as to introduce wet air supercharged through the blower 100 into the cooling space A of the cooling module 210; and an air outlet 240 formed to penetrate an upper portion of the cooling module 210 so as to discharge dry air, which had been converted in the cooling space A, toward the heat exchange unit 300.

More specifically, the cooling module 210 is generally formed in a cylindrical shape so that wet air flowing into the cooling space A through the air inlet 230 can have a swirling flow inside, and at least a portion of a lower side of the cooling module 210 may be formed in a conical shape in which a diameter thereof gradually decreases toward the lower side so that moisture separated by centrifugal force from wet air having a swirling flow can be collected.

In addition, the cooling module 210 may be configured to have cryogenic insulation so as to prevent cooling energy released from hydrogen flowing through the cooling line 220, which will be described later, from dissipating to outside of the cooling module 210, and so that moisture in wet air flowing into the cooling space A of the cooling module 210 may be effectively coagulated and condensed by cooling energy and be discharged. To this end, an insulating material may be formed on at least a portion of a wall surface of the cooling module 210. For example, at least one of foam, aerogel, and glass fiber may be used as such insulating material. However, the material of the insulating material is not necessarily limited thereto, and any material capable of insulating the cooling space A inside the cooling module 210 at cryogenic temperature may be applied.

At this time, as shown in FIG. 1 and FIG. 2, the air inlet 230 is formed on an upper side of the cooling module 210 to be in contact with an outer circumferential surface of the cooling module 210, thereby inducing wet air flowing into the cooling space A to have a swirling flow from an upper side to a lower side along the cooling line 220 spirally formed in the cooling space A.

In addition, the air outlet 240 may be formed in a cylindrical shape having an axis coaxial with a central axis of the cooling module 210, and may penetrate an upper portion of the cooling module 210 and extend in a direction toward a lower side of the cooling space A.

In addition, the cooling line 220 may be formed in a downward spiral shape spirally extending from an upper side to a lower side along an inner circumferential surface of the cooling module 210 having a circular cross-section. At this time, the cooling line 220 may release cooling energy, which had been generated in a process that at least a portion of hydrogen is vaporized, to the cooling space A, and may discharge hydrogen mixed in a liquid state and a gaseous state toward the heat exchange unit 300.

Therefore, in the moisture eliminator 200, wet air containing moisture may flow tangentially into the cooling space A of the cooling module 210 through an air inlet 230, become a swirling flow, and descend along a cylindrical portion and a conical portion of the cooling module 210 in a spiral shape. During this time, moisture contained in wet air is condensed by cooling energy generated in the cooling line 220 formed in a downward spiral shape along the swirling flow of wet air, and then is separated by centrifugal force according to the swirling flow of wet air, and thus wet air can be converted into dry air.

In this way, dry air from which moisture has been removed can be discharged toward the heat exchange unit 300 through an air outlet 240 formed to penetrate an upper side of the cooling module 210 from the central axis of the cooling module 210.

In this case, as in the liquid hydrogen vaporization system 2000 according to the other embodiment of the present disclosure shown in FIG. 3, a filter F may be installed in at least a partial section inside the air outlet 240, thereby filtering moisture remaining in dry air to be discharged to outside of the cooling module 210 and removing moisture more effectively.

Here, the filter F may include a porous material, a perforated plate, or a scrubber-shaped metal mesh. In addition to this, the filter F may include any material capable of filtering and removing moisture remaining in dry air.

In this way, when wet air flows into the moisture eliminator 200, due to low temperature of liquid hydrogen, moisture (water vapor) or carbon dioxide in wet air condenses and coagulates, and is separated by centrifugal force of wet air swirling inside the moisture eliminator 200, and then falls to a lower portion of the cooling module 210 by gravity to be temporarily stored, and thus only dry air, from which moisture has been removed, can be discharged to outside of the moisture eliminator 200 through the air outlet 240.

In this case, moisture temporarily stored by falling to a lower side of the cooling module 210 may be accumulated in the cooling module 210 by a predetermined collection amount set in advance, or may be discharged to outside through a drain valve (not shown) connected to the lower side of the cooling module 210 when an operation is stopped.

In this way, some of moisture separated from wet air falls to the lower side of the cooling module 210, accumulates to a certain amount, and is then discharged to outside, and the other portion may remain in a condensed state on an inner circumferential surface of the cooling module 210. However, unlike a typical plant, the moisture eliminator 200 of the present disclosure does not continuously vaporize liquid hydrogen, but operates only while a vehicle is in operation. Thus, when a corresponding vehicle stops operating, moisture, which had been condensed inside, vaporizes in a process that temperature of the moisture eliminator 200 rises again to room temperature, and is eliminated in the cooling module 210, such that the moisture eliminator 200 can be in a state that may be used again without being affected by moisture condensed therein.

As shown in FIG. 1, the heat exchange unit 300 may heat hydrogen through heat exchange between dry air and hydrogen so as to vaporize hydrogen in a liquid state supplied from the hydrogen tank 10 into a gaseous state to supply the same to a fuel cell 20.

For example, the heat exchange unit 300 may include a first heat exchanger 310, which is installed on a hydrogen line 1 connecting the moisture eliminator 200 and the fuel cell 20 and heats hydrogen to a first heating temperature through heat exchange between dry air and hydrogen; and a second heat exchanger 320, which is installed at a rear of the first heat exchanger 310 on the hydrogen line 1 based on a flow direction of hydrogen flowing through the hydrogen line 1 toward the fuel cell 20 and heats hydrogen to a second heating temperature higher than the first heating temperature through heat exchange between dry air and hydrogen.

Here, the first heat exchanger 310 and the second heat exchanger 320 may use plate-fin heat exchangers with high heat exchange efficiency, thereby heating hydrogen to vaporization temperature or higher through multi-stage heat exchange between dry air and hydrogen. The plate-fin heat exchanger is one of plate-type heat exchangers and may be formed in a shape in which layers of corrugated fins are stacked between metal plates.

At this time, when air containing moisture passes through the plate-fin heat exchanger, condensation occurs in a micro-channel due to moisture, so in case that an evaporator is configured with wet air, the plate-fin heat exchanger cannot be used, and thus it is inevitable to use a low-efficiency heat exchanger (a pipe-type stationary heat exchanger using natural convection) in a form of a conventional evaporator. However, in the present disclosure, dry air may be generated through the moisture eliminator 200 at a front of the heat exchange unit 300 and heat exchange between moisture-free dry air and hydrogen is performed, so that it becomes possible to use the plate-fin heat exchanger in the heat exchange unit 300. In addition to this, any heat exchanger having a micro-channel similar to that of the plate-fin heat exchanger, such as a micro-channel heat exchanger, can be used.

In the heat exchange unit 300, the second heat exchanger 320 having relatively higher heating temperature than the first heat exchanger 310 may increase temperature of hydrogen, which had been primarily heated by the first heat exchanger 310, to gaseous hydrogen at room temperature and supply it to the fuel cell 20.

In addition, the first heat exchanger 310 may cool dry air to a predetermined liquefaction temperature or lower through heat exchange between dry air and hydrogen, thereby separating this cooled dry air into liquefied air or liquid nitrogen and liquefied oxygen and producing the same, which can be an ancillary effect.

In this embodiment, the above-described heat exchange unit 300 is exemplified as having two heat exchangers 310, 320 and heating hydrogen in a liquid state in multiple stages to vaporize hydrogen into a gaseous state, but is not limited thereto. The heat exchange unit 300 may be configured to have a wide variety of numbers of heat exchangers considering energy balance for efficient multi-stage heat exchange between dry air and hydrogen. In addition to this, in case of being used only for a purpose of vaporizing hydrogen without liquefying dry air, it may also be configured as a single heat exchanger.

Furthermore, as shown in FIG. 1, the heat exchange unit 300 may include a distributor 330 for controlling and distributing an amount of dry air that is supplied to at least one of the first heat exchanger 310 and the second heat exchanger 320.

For example, the distributor 330 may be installed at a branch of an air line 2, which connects the moisture eliminator 200 and the heat exchange unit 300 and branches in a middle to connect the first heat exchanger 310 and the second heat exchanger 320 in parallel and flows dry air to the first heat exchanger 310 and the second heat exchanger 320, respectively.

Accordingly, the distributor 330 may be installed at a rear of the moisture eliminator 200 based on a flow direction of dry air, and distribute dry air discharged from the moisture eliminator 200 at a predetermined distribution ratio and serve to supply this distributed dry air to the first heat exchanger 310 and the second heat exchanger 320, respectively.

Here, the distributor 330 may be driven by a control to regulate an amount by which the first heat exchanger 310 liquefies dry air. For example, temperature and pressure can be measured at an air outlet of the first heat exchanger 310 to check whether dry air is liquefied, and in order to maximize liquidation amount of dry air, a distribution flow rate of dry air supplied to the first heat exchanger 310 for liquefaction can be controlled.

At this time, dry air distributed to the second heat exchanger 320 through the distributor 330 may be supplied to the second heat exchanger 320 on the air line 2 while being heated to room temperature or higher by a heater 340 installed in a front of the second heat exchanger 320 based on a flow direction of dry air, thereby serving to induce hydrogen to be completely vaporized into a gaseous state in the second heat exchanger 320 through heat exchange with hydrogen.

However, an installation position of the distributor 330 is not necessarily limited to FIG. 1, and as in a liquid hydrogen vaporization system 3000 according to another embodiment of the present disclosure shown in FIG. 4, the distributor 330 may be installed between the second heat exchanger 320 and the first heat exchanger 310 on the air line 2, which connects the moisture eliminator 200 and the heat exchange unit 300 and connects the second heat exchanger 320 and the first heat exchanger 310 in series to flow dry air in an order of the second heat exchanger 320 and the first heat exchanger 310 based on a flow direction of dry air.

Accordingly, the distributor 330 may be installed between the heat exchangers 310, 320 based on a flow direction of dry air, and may distribute dry air, which had been separated into oxygen gas and nitrogen gas in a process of passing through the second heat exchanger 320, at a predetermined distribution ratio and may supply them to the first heat exchanger 310 or may discharge them to atmosphere. In this case, dry air that has not been distributed to the first heat exchanger 310 may be discharged into atmosphere through the distributor 330.

Hereinafter, a liquid hydrogen vaporization method using the above-described liquid hydrogen vaporization systems 1000, 2000, 3000 will be described in detail.

Figure 5:
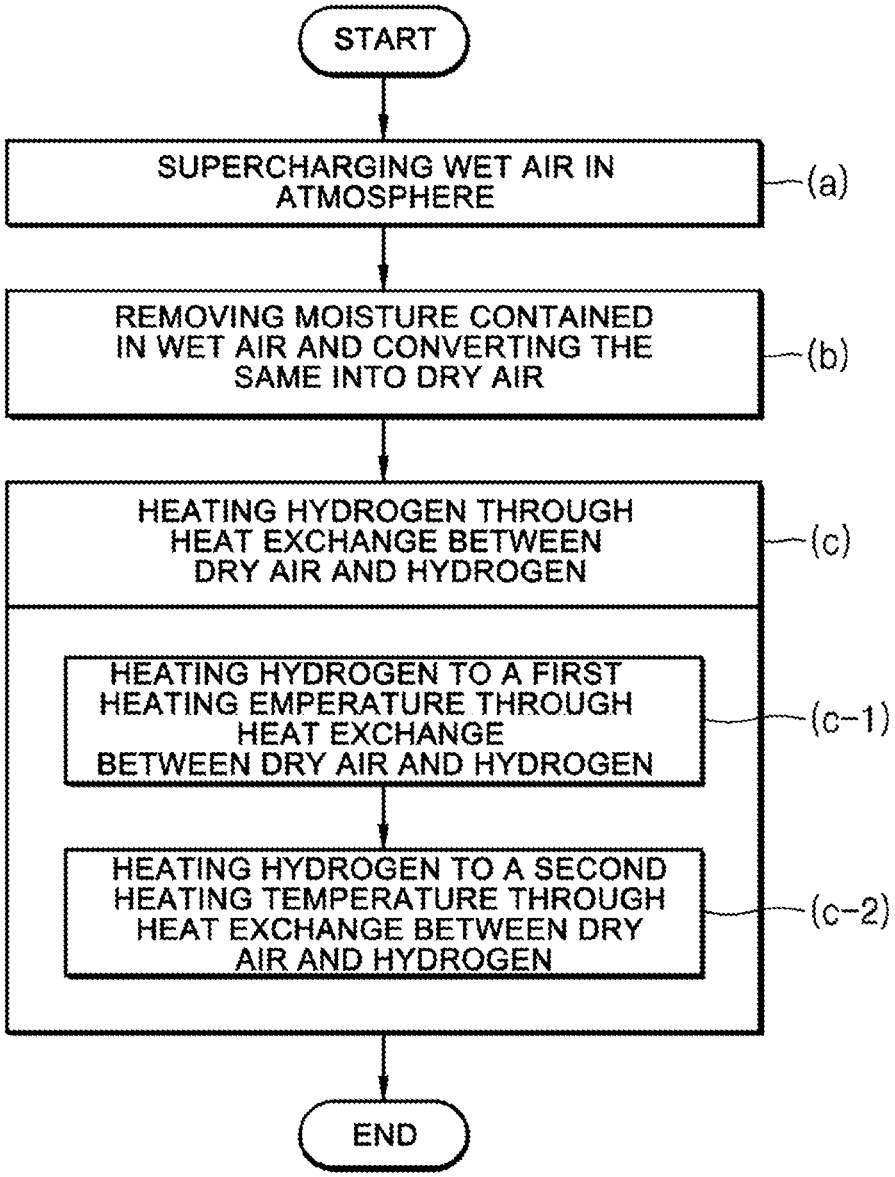
FIG. 5 is a flowchart sequentially showing a liquid hydrogen vaporization method according to an embodiment of the present disclosure.

FIG. 5 is a flowchart sequentially showing a liquid hydrogen vaporization method according to an embodiment of the present disclosure.

As shown in FIG. 5, the liquid hydrogen vaporization method may comprise (a) supercharging wet air in atmosphere; (b) removing moisture contained in supercharged wet air and converting wet air into dry air; and (c) heat exchanging by heating hydrogen through heat exchange between dry air and hydrogen so that hydrogen in a liquid state supplied from a hydrogen tank 10 can be vaporized into a gaseous state and supplied to a fuel cell 20.

At this time, in (b), moisture contained in wet air can be removed by condensing moisture contained in wet air by using cooling energy released when hydrogen supplied from the hydrogen tank 10 vaporizes.

In addition, (c) may include (c-1) a first heat exchanging by heating hydrogen to a first heating temperature through heat exchange between dry air, which had been converted in (b), and hydrogen supplied from the hydrogen tank 10; and (c-2) a second heat exchanging by heating hydrogen to a second heating temperature higher than the first heating temperature through secondary heat exchange between dry air, which had been converted in (b), and hydrogen, which had been primarily heated to the first heating temperature, so as to completely vaporize hydrogen into a gaseous state; and (c-1) and (c-2) may be performed through plate-fin heat exchangers.

In (c-2), in order to increase vaporization efficiency of hydrogen, it is possible to heat dry air to room temperature or higher by passing dry air through a heater 340 before heat exchange with hydrogen. In addition, in (c-1), dry air may be cooled to a predetermined liquefaction temperature or lower through heat exchange between dry air and hydrogen and be separated into liquefied air or liquid nitrogen and liquefied oxygen to be discharged separately.

Therefore, according to liquid hydrogen vaporization systems 1000, 2000, 3000 and liquid hydrogen vaporization methods according to various embodiments of the present disclosure, for heat exchange with hydrogen, moisture contained in wet air in atmosphere that flows into the heat exchange unit 300 can be removed through condensation preprocessing by using cooling energy released when hydrogen vaporizes, and wet air flowing into the heat exchange unit 300 is converted to dry air, thereby preventing freezing of the heat exchangers 310, 320 due to moisture contained in air in a process of heat exchange.

Accordingly, freezing can be prevented during a heat exchange process in the heat exchange unit 300 such that it becomes possible to configure a hydrogen supply system of a fuel cell in which plate-fin heat exchangers that can effectively vaporize liquid hydrogen are applied to a heat exchange unit 300 as the heat exchangers 310, 320. In addition, dry air is liquefied by using cooling energy generated when liquid hydrogen vaporizes, in a process of heat exchange between hydrogen and dry air in the heat exchangers 310, 320, thereby achieving an effect of producing liquid nitrogen and liquid oxygen together.

Although the above has shown and described various embodiments of the present disclosure, the present disclosure is not limited to the specific embodiments described above. The above-described embodiments can be variously modified and implemented by those skilled in the art to which the present invention pertains without departing from the gist of the present disclosure claimed in the appended claims, and these modified embodiments should not be understood separately from the technical spirit or scope of the present disclosure. Therefore, the technical scope of the present disclosure should be defined only by the appended claims.

In the embodiments disclosed herein, arrangement of illustrated components may vary depending on requirements or environment in which the invention is implemented. For example, some components may be omitted or some components may be integrated and implemented as one.

What is claimed is:

1. A liquid hydrogen vaporization system, comprising, a blower for supercharging wet air in atmosphere;

a moisture eliminator for removing moisture contained in the wet air supercharged through the blower and converting the wet air into dry air; and a heat exchange unit for heating hydrogen through heat exchange between the dry air and the hydrogen so that the hydrogen in a liquid state supplied from a hydrogen tank can be vaporized into a gaseous state and supplied to a fuel cell, wherein the moisture eliminator is configured to condense moisture contained in the wet air by using cooling energy released when the hydrogen supplied from the hydrogen tank vaporizes, thereby removing moisture contained in the wet air.

2. The liquid hydrogen vaporization system according to claim 1, wherein the moisture eliminator includes:

a cooling module for forming a cooling space in which the wet air can be cooled and converted into the dry air;

a cooling line formed in a spiral shape along an inner circumferential surface of the cooling module and flowing the hydrogen supplied from the hydrogen tank toward the heat exchange unit so as to form a cooling atmosphere in the cooling space;

an air inlet formed to penetrate a side portion of the cooling module so as to introduce the wet air supercharged through the blower into the cooling space of the cooling module; and an air outlet configured to penetrate an upper portion of the cooling module so as to discharge the dry air, which had been converted in the cooling space, toward the heat exchange unit.

3. The liquid hydrogen vaporization system according to claim 2, wherein the cooling line is formed in a downward spiral shape spirally extending from an upper side to a lower side along the inner circumferential surface of the cooling module.

4. The liquid hydrogen vaporization system according to claim 2, wherein the cooling line releases cooling energy, which had been generated in a process that at least a portion of the hydrogen is vaporized, to the cooling space, and discharges the hydrogen mixed in a liquid state and a gaseous state toward the heat exchange unit.

5. The liquid hydrogen vaporization system according to claim 2, wherein the air inlet is formed on an upper side of the cooling module to be in contact with an outer circumferential surface of the cooling module so that the wet air flowing into the cooling space has a swirling flow from an upper side to a lower side along the cooling line that is spirally formed in the cooling space.

6. The liquid hydrogen vaporization system according to claim 2, wherein the air outlet is formed in a cylindrical shape having an axis coaxial with a central axis of the cooling module, and penetrates the upper portion of the cooling module and extends in a direction toward a lower side of the cooling space.

7. The liquid hydrogen vaporization system according to claim 6, wherein the air outlet is installed with a filter in at least a partial section thereof so as to filter moisture remaining in the dry air to be discharged to outside of the cooling module.

8. The liquid hydrogen vaporization system according to claim 1, wherein the heat exchange unit includes:

a first heat exchanger installed on a hydrogen line connecting the moisture eliminator and the fuel cell, heating the hydrogen to a first heating temperature through heat exchange between the dry air and the hydrogen.

9. The liquid hydrogen vaporization system according to claim 8, wherein the first heat exchanger cools the dry air to a predetermined liquefaction temperature or lower through heat exchange between the dry air and the hydrogen, and separates the cooled dry air into the liquefied air or liquid nitrogen, together with ((and)) liquefied oxygen, to discharge them separately.

10. The liquid hydrogen vaporization system according to claim 8, wherein the heat exchange unit includes:

a second heat exchanger installed at a rear of the first heat exchanger on the hydrogen line based on a flow direction of the hydrogen flowing through the hydrogen line toward the fuel cell, heating the hydrogen to a second heating temperature higher than the first heating temperature through heat exchange between the dry air and the hydrogen.

11. The liquid hydrogen vaporization system according to claim 10, wherein the heat exchange unit further includes:

a distributor for controlling and distributing an amount of the dry air supplied to at least one of the first heat exchanger and the second heat exchanger.

12. The liquid hydrogen vaporization system according to claim 11, wherein the distributor is installed at a branch of an air line, which connects the moisture eliminator and the heat exchange unit and branches in a middle to connect the first heat exchanger and the second heat exchanger in parallel and flows the dry air to the first heat exchanger and the second heat exchanger, respectively; and distributes the dry air discharged from the moisture eliminator at a predetermined distribution ratio and discharges the distributed dry air to the first heat exchanger and the second heat exchanger.

13. The liquid hydrogen vaporization system according to claim 11, wherein the distributor is installed between the second heat exchanger and the first heat exchanger on the air line, which connects the moisture eliminator and the heat exchange unit, connects the second heat exchanger and the first heat exchanger in series, and flows the dry air in an order of the second heat exchanger and the first heat exchanger based on a flow direction of dry air, and distributes the dry air, which had been separated into oxygen gas and nitrogen gas in a process of passing through the second heat exchanger, at a predetermined distribution ratio, to be discharged to the first heat exchanger and atmosphere.

14. The liquid hydrogen vaporization system according to claim 10, wherein the heat exchange unit further includes:

a heater installed, on an air line, in front of the second heat exchanger based on a flow direction of the dry air, heating the dry air flowing into the second heat exchanger to room temperature or higher.

15. The liquid hydrogen vaporization system according to claim 10, wherein the first heat exchanger and the second heat exchanger are plate-fin heat exchangers.

16. A liquid hydrogen vaporization system, comprising, a blower for supercharging wet air in atmosphere;

a moisture eliminator for removing moisture contained in the wet air supercharged through the blower and converting the wet air into dry air; and a heat exchange unit for heating the hydrogen through heat exchange between the dry air and the hydrogen so that the hydrogen in a liquid state supplied from a hydrogen tank can be vaporized into a gaseous state and supplied to a fuel cell, wherein the moisture eliminator includes:

a cooling module for forming a cooling space in which the wet air can be cooled and converted into the dry air by condensing moisture contained in the wet air by using cooling energy released when the hydrogen supplied from the hydrogen tank vaporizes so as to remove moisture contained in the wet air;

a cooling line formed in a downward spiral shape from an upper side to a lower side along an inner circumferential surface of the cooling module so as to form a cooling atmosphere in the cooling space, releasing cooling energy, which had been generated in a process that at least a portion of the hydrogen is vaporized, to the cooling space, and discharging the hydrogen mixed in a liquid state and a gaseous state toward the heat exchange unit;

an air inlet formed on an upper side of the cooling module to be in contact with an outer circumferential surface of the cooling module and to penetrate a side portion of the cooling module so as to introduce the wet air supercharged through the blower into the cooling space of the cooling module; and an air outlet formed in a cylindrical shape having an axis coaxial with a central axis of the cooling module so as to discharge the dry air, which had been converted in the cooling space, toward the heat exchange unit, penetrating an upper portion of the cooling module and extending in a direction toward a lower side of the cooling space;

wherein the heat exchange unit includes:

a first heat exchanger installed on a hydrogen line connecting the moisture eliminator and the fuel cell, heating the hydrogen to a first heating temperature through heat exchange between the dry air and the hydrogen;

a second heat exchanger installed at a rear of the first heat exchanger on the hydrogen line based on a flow direction of the hydrogen flowing through the hydrogen line toward the fuel cell, heating the hydrogen to a second heating temperature higher than the first heating temperature through heat exchange between the dry air and the hydrogen;

a distributor for controlling and distributing an amount of the dry air supplied to at least one of the first heat exchanger and the second heat exchanger; and a heater installed in front of the second heat exchanger based on a flow direction of the dry air, heating the dry air flowing into the second heat exchanger to room temperature or higher;

wherein the first heat exchanger and the second heat exchanger are plate-fin heat exchangers.

17. A liquid hydrogen vaporization method, comprising the following steps, (a) supercharging wet air in atmosphere;

(b) removing moisture contained in the supercharged wet air and converting the wet air into dry air; and (c) heat exchanging for heating the hydrogen through heat exchange between the dry air and the hydrogen so that the hydrogen in a liquid state supplied from a hydrogen tank can be vaporized into a gaseous state and supplied to a fuel cell;

wherein (b) includes:

condensing moisture contained in the wet air by using cooling energy released when the hydrogen supplied from the hydrogen tank vaporizes, thereby removing moisture contained in the wet air.

18. The liquid hydrogen vaporization method according to claim 17, wherein step (c) includes:

(c-1) a first heat exchanging for heating the hydrogen to a first heating temperature through heat exchange between the dry air, which had been converted in (b), and the hydrogen supplied from the hydrogen tank; and (c-2) a second heat exchanging for heating the hydrogen to a second heating temperature higher than the first heating temperature through heat exchange between the dry air, which had been converted in (b), and the hydrogen heated to the first heating temperature; and wherein steps (c-1) and (c-2) are performed through plate-fin heat exchangers.

19. The liquid hydrogen vaporization method according to claim 18, wherein, in step (c-1), the dry air is cooled to a predetermined liquefaction temperature or lower through heat exchange between the dry air and the hydrogen, and is separated into liquefied air or liquid nitrogen, together with ((and)) liquefied oxygen, to be discharged separately.

20. The liquid hydrogen vaporization method according to claim 18, wherein step (c-2) includes:

heating the dry air to room temperature or higher by passing the dry air through the heater before heat exchange with the hydrogen.

* * * * *